United States Patent [19]

Premus

[11] 4,066,048

[45] Jan. 3, 1978

[54] UNIVERSAL AXIAL SPACER FOR MOUNTING FAN ON PUMP SHAFT AND DRIVE PULLEY

[76] Inventor: Donald D. Premus, 555 E. Ramsey St., Banning, Calif. 92220

[21] Appl. No.: 782,357

[22] Filed: Mar. 29, 1977

Related U.S. Application Data

[63] Continuation of Ser. No. 621,011, Oct. 9, 1975, abandoned.

[51] Int. Cl.[2] ..... F01D 7/10; F01D 7/04; F16H 7/22

[52] U.S. Cl. ..... 123/41.49; 74/230.4; 123/41.65

[58] Field of Search ..... 123/41.11, 41.49, 41.65, 123/41.63; 74/230.3, 230.4

[56] References Cited

U.S. PATENT DOCUMENTS

| | | | |
|---|---|---|---|
| 3,589,149 | 6/1971 | Fischer | 74/230.4 |
| 3,659,471 | 5/1972 | Marsch | 74/230.3 |
| 3,741,025 | 6/1973 | Russell | 74/230.4 |

*Primary Examiner*—Leonard H. Gerin
*Attorney, Agent, or Firm*—Dana E. Keech

[57] ABSTRACT

A special fan hub designed to neatly replace the fan idling clutch in practically all new and used American makes of automobiles and directly mount the fan on the fan drive pulley.

6 Claims, 6 Drawing Figures

FIG. 1.
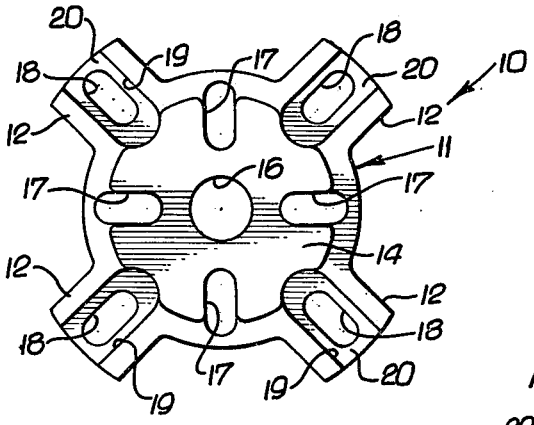
FIG. 2.
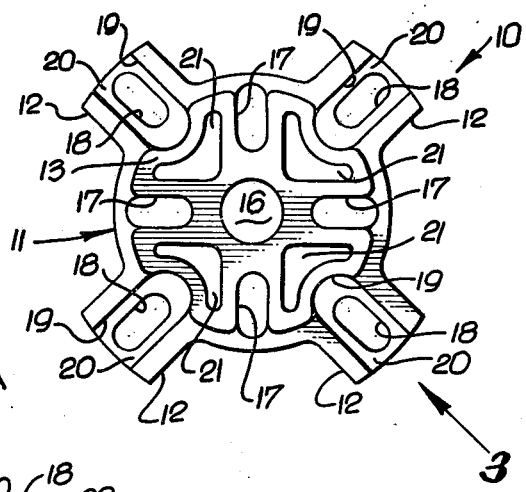
FIG. 3.
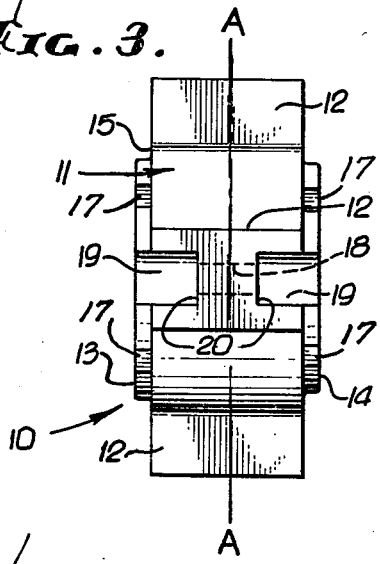
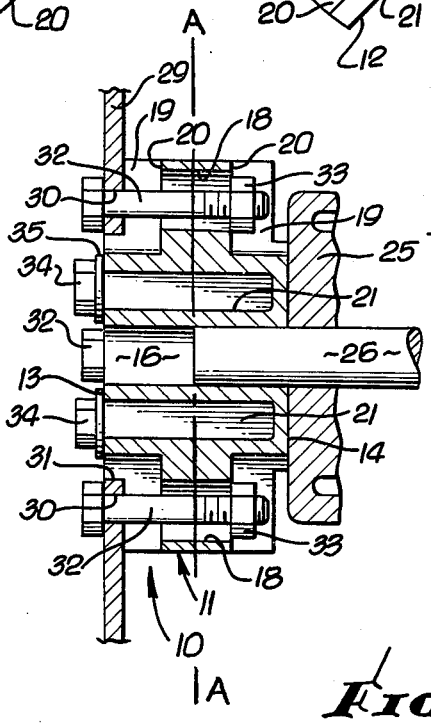
FIG. 6.
FIG. 4.
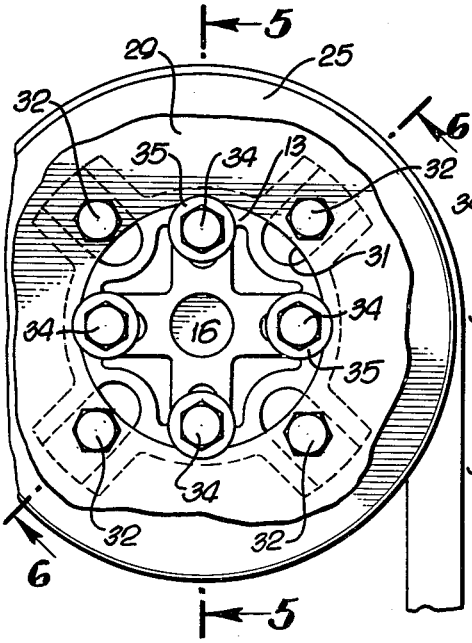
FIG. 5.
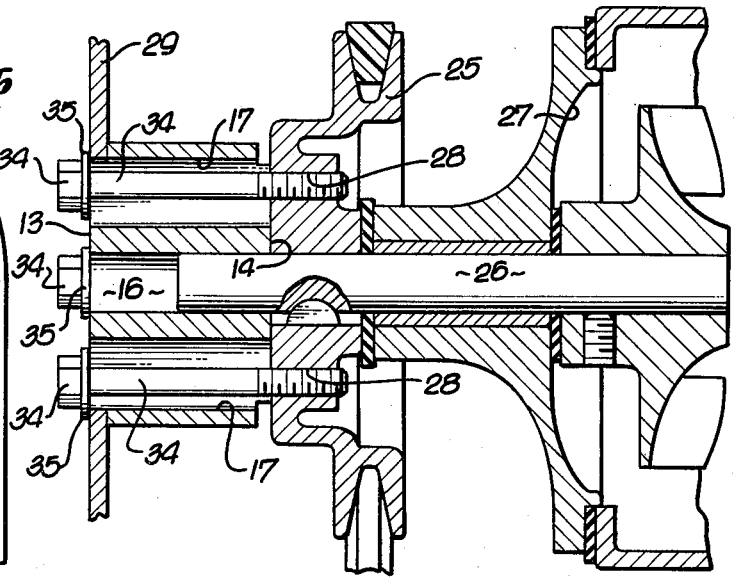

UNIVERSAL AXIAL SPACER FOR MOUNTING FAN ON PUMP SHAFT AND DRIVE PULLEY

This application is a continuation of Ser. No. 621,011 filed Oct. 9, 1975, now abandoned.

SUMMARY OF THE INVENTION

The purpose for providing the fan idling clutch was to automatically de-clutch the fan when driving at speeds in excess of fifty-five miles per hour and thus prevent the fan retarding the inflowing stream of cooling air.

With the enactment and rigid enforcement of the national highway speed limit of fifty-five miles per hour, the need for the fan idling clutch is eliminated.

To the millions of American motorists whose cars are equipped with fan idling clutches, however, these devices continue to be a source of expense for servicing and, in the event of failure, for replacement.

It is an object of the present invention to provide a relatively inexpensive die cast hub which can be substituted readily for the fan idling clutch in practically all existing American makes of automobiles and affording a means for rigidly axially mounting the fan on the fan drive pulley.

Another object of the invention is to provide such a hub having four radial slots for accommodating four bolts passing through said hub and screwing into four tapped holes already provided in the fan drive pulley which holes are located at different radii in different cars.

A further object is to provide such a hub embodying four radial slots for accommodating four bolts passing through said hub and through holes already provided in the fan itself which latter holes are located at different radii in different cars, and providing shoulders in said slots for nuts on said bolts to abut against.

A still further object is to provide such a hub having a central bore of five-eighths inch which fits the fan belt pulley shaft in practically all existing American cars when either end of the hub is applied thereto, and in which the nut supporting shoulders aforementioned are duplicated in said hub for service irrespective of which end of the hub is applied to said shaft, and in which opposite ends of said hub are provided with fan centralizing bosses differing in outside diameters so that one or the other of said bosses will fit the central bore of the fan of practically any existing American automobiles.

BRIEF DESCRIPTION OF THE DRAWINGS

FIG. 1 is an end elevational view of a preferred embodiment of the invention.

FIG. 2 is an opposite end elevational view of the hub of the invention.

FIG. 3 is a side elevational view taken in the direction of arrow 3 in FIG. 2.

FIG. 4 is a fragmentary front elevational view of the hub of the invention displacing a fan idling clutch and mounting the fan rigidly and axially on the fan drive pulley.

FIG. 5 is a fragmentary vertical sectional view taken on the line 5—5 of FIG. 4.

FIG. 6 is a fragmentary sectional view taken on the line 6—6 of FIG. 4.

DETAILED DESCRIPTION OF THE PREFERRED EMBODIMENT

The invention comprises a hub 10 which is preferably embodied in a light-alloy-380 die casting which includes a cylindrical body 11 having four short arms 12 extending at 90° intervals from the periphery thereof. Flat axial centralizing end bosses 13 and 14 are raised 0.156 inch above flat radial peripheral end areas 15 of the body 11. The diameter, generally, of the boss 13 is 2.625 inches. The diameter of the boss 14 is 2.375 inches. The OD of body 11 is 2.875 inches while the distance from the tip of one arm 12 to the tip of its opposite arm is 4 inches. The axial length of body 11 is 1.812 inches. The axial distance between areas 15 is 1.50 inches.

A central bore 16 of 0.63 inch extends through body 11. Formed also therein and extending therethrough in radial planes bisecting the angles between the radial axial planes of symmetry of arms 12 are four round ended slots 17 which are 0.343 inch wide, 0.656 inch long and are spaced respectively 0.625 inch from the central axis of the body 11.

Formed in the short arms 12 symmetrical with their radial axial planes and extending short distances into cylindrical body 11 and axially entirely through hub 10 are four round ended slots 18 which are 0.330 inch wide, 0.625 inch long and are spaced respectively 1.25 inches from the central axis of the body 11. End portions of each slot 18 (0.375 inch long) are enlarged symmetrically to a width of 0.500 inch, to form nut receiving chambers 19 providing nut holding shoulders 20. Core holes 21 are drawn from boss 13 for lightening the hub 10.

OPERATION

The above described hub 10 of the invention is provided for the purpose of displacing the fan idling clutch conventionally incorporated with American made automobiles and which has lost its utility under current restrictions in the nationally permissible highway speed limit.

The character of said fan idling clutch being so well known, and being no part of the present invention, it is not disclosed herein except to say said clutch is mounted on the fan drive pulley 25 (see FIGS. 5 and 6) which in turn is fixed on the shaft 26 of the automobile engine water pump 27. The attachment of the fan idling clutch to the fan drive pulley is by four quarter inch bolts, (not shown) which screw into four bolt holes 28 provided in said pulley. The clutch includes two relatively rotatable elements one of which is attached, as aforesaid, to the fan drive pulley, and the other of which elements is secured to the fan 29 by four quarter inch bolts passing through four holes 30 provided in the fan 29 and screwing into tapped holes provided therefor in said second fan idling clutch element. The latter element is also centralized with respect to said fan 29 by a boss provided on said element which fits closely within a central bore 31 provided in the fan.

Applicant's conception of the idea of benefiting auto owners by providing an inexpensive device for eliminating the fan idling clutch from his engine was followed by an extensive review of the dimensions of the elements such as the fan 29 and the fan drive pulley 25 which might be retained in any such conversion in all the wide variety of existing automobiles on the road in America which are subject to this problem.

Applicant discovered that the centralizing fan bores 31 in fans 29 provided by American car manufacturers are either 2.63 inches in diameter or 2.88 inches in diameter and that the radii upon which the holes 30 are centered in the fans 29 correspondingly vary in different makes of American automobiles. Applicant also discovered that the radii upon which tapped holes 28 are centered in pulley 25 in different cars vary as much as 0.34 inch.

The foregoing statistical information laid the foundation for the preferred structure and dimensions for the hub 10 of the invention above described. This hub is shown in FIGS. 4, 5 and 6 as assembled to unite the fan 29 direcly and rigidly to the fan drive pulley of a particular Chrysler automobile, after the fan idling clutch thereof had been removed. This was done by the following steps:

1. The boss 13 of the hub 10 is inserted into the fan centralizing bore 31.
2. Four 174 inch by 1½ inch bolts 32 are inserted through fan bolt holes 30.
3. Nuts 33 are placed in the rearmost nut receiving chambers 19 of the hub 10.
4. Bolts 32 are screwed into the nuts 33 and tightened.
5. The hub with the fan thus mounted thereon is advanced, axially aligned with shaft 26, to receive the latter and abut against the fan drive pulley 25.
6. The hub 10 is turned on shaft 26 to align hub slots 17 with tapped pulley holes 28.
7. Four ¼ inch by 2½ inch bolts 34 are inserted through heavy washers 35 and then through radial slots 17 and are then screwed into tapped holes 28 and tightened.

This completes the displacement, in this particular Chrysler car, of the fan idling clutch by the hub 10 of the present invention. The same procedure as above described is followed to make such a displacement with all cars in which the centralizing fan bore 30 fits hub boss 13. In all other cases, the hub 10 is simply turned end for end with the boss 14 pointed forwardly, whereupon this boss will fit within the fan centralizing bore 30 and allow the displacement of the fan idling clutch to proceed through the remainder of the numbered steps above recited.

Present data indicates that in all American cars employing fan idling clutches the pump and fan drive pulley shaft has an OD of ⅝ inch with the exception of the Oldsmobile (Tornado) and the 1967 Cadillac in which the shaft ODs are respectively 11/16 inch and ¾ inch. A simple reaming operation of the bore 16 of hub 10 is all that is required to adapt the present invention to these exceptional deviations from the rule in regard to the pump shaft diameter.

I claim:

1. In a fan spacer adapted to unite existing fans with existing pump drive shafts and pulleys on an engine, the combination of a spacer body having a bore adapted either without reaming, or with reaming, where required, to fit any of said shafts;

an axial fan centralizing boss on one end of said body, said boss fitting a bore already provided in one group of said fans;

four primary radial slots in said body for accommodating four parallel bolts disposable freely at varying radii from the axis of said body and screwing into tapped holes already provided in said pulleys to secure said body axially to one of said pulleys; and four secondary radial slots in said body equally interspersed circumferentially between said primary radial slots and accommodating another four bolts for securing said fan to said body by extending said bolts through said secondary slots and through bolt holes already provided in said fan.

2. A combination as recited in claim 1 wherein nut receiving recesses are provided at opposite ends of said secondary slots forming nut stop shoulders symmetric with the medial radial plane A—A of said body, thereby rendering said secondary slots operative irrespective of which end of said body is disposed forwardly, said centralizing boss fitting the axial fan bores only in a certain portion of existing American cars; and a second centralizing boss on the opposite end of said body which only fits the axial fan bores in a different portion of existing American cars.

3. A combination as recited in claim 1 wherein said body includes a central portion; and four short arms extending radially from the periphery of said central body portion, said primary four radial slots being provided in said central body portion, and said secondary four radial slots being provided mainly in said four arms.

4. A fan spacer adapted to unite existing fans with existing pump drive shafts and pulleys on engines, the combination of a spacer body having a central body with first and second end portions, said body having a main bore through said first and second end portions for mounting on a shaft, a fan centralizing boss on one end portion of said body, said boss fitting a bore provided in a fan;

a second fan centralizing boss of different size formed in said body in the other end portion thereof for cooperation with other size fan bores;

four primary slots formed through said body and its respective end portions so that primary slots extend radially outwardly with respect to the axis of the main bore, said primary slots accommodating four parallel bolts disposable freely in said primary slots at varying radii from said main bore axis for securing said body to a pulley; and four secondary slots in said body interspersed circumferentially between the primary radial slots and accommodating another four bolts for securing said fan to said body.

5. The combination as recited in claim 4, wherein nut receiving recesses are provided in said secondary slots in each end portion of said body, thereby rendering said secondary slots operative irrespective of which end portion of said body and its respective centralizing boss is used.

6. The combination as recited in claim 4, wherein four short arms extend radially from the periphery of said central body portion, said secondary four radial slots being located respectively in said four arms.

* * * * *